United States Patent [19]

Buth et al.

[11] Patent Number: 4,928,928

[45] Date of Patent: May 29, 1990

[54] GUARDRAIL EXTRUDER TERMINAL

[75] Inventors: C. Eugene Buth; Asif Qureshy, both of College Station; Hayes E. Ross, Jr., Bryan; Dean L. Sicking, College Station, all of Tex.

[73] Assignee: The Texas A&M University System, College Station, Tex.

[21] Appl. No.: 143,367

[22] Filed: Jan. 12, 1988

[51] Int. Cl.[5] ..... E01F 15/00

[52] U.S. Cl. ..... 256/13.1; 256/19; 404/6; 188/377

[58] Field of Search ..... 256/13.1, 19, 1; 404/6, 404/9, 10; 403/2, 279, 284; 188/377, 371; 293/133, 110

[56] References Cited

U.S. PATENT DOCUMENTS

| | | | |
|---|---|---|---|
| Re. 29,544 | 2/1978 | Fitch . | |
| 2,135,705 | 11/1938 | Florance | 256/13.1 |
| 2,146,445 | 2/1939 | Russert et al. | 256/13.1 X |
| 3,519,301 | 7/1970 | Somnitz | 188/371 X |
| 3,643,924 | 2/1972 | Fitch | 256/13.1 |
| 3,768,781 | 10/1973 | Walker et al. | 256/13.1 X |
| 3,779,591 | 12/1973 | Rands | 293/133 |
| 4,063,713 | 12/1977 | Anolick et al. | 256/13.1 |
| 4,073,482 | 2/1978 | Seegmiller et al. . | |
| 4,274,665 | 6/1981 | Marsh, Jr. | 403/279 X |
| 4,289,419 | 9/1981 | Young et al. . | |
| 4,352,484 | 10/1982 | Gertz et al. . | |
| 4,389,134 | 6/1983 | Colas | 403/284 X |
| 4,399,980 | 8/1983 | van Schie | 188/377 X |
| 4,557,466 | 12/1985 | Zucker . | |
| 4,583,716 | 4/1986 | Stephens et al. . | |
| 4,607,824 | 9/1986 | Krage et al. . | |
| 4,635,981 | 1/1987 | Friton . | |
| 4,655,434 | 4/1987 | Bronstad | 403/2 X |
| 4,666,130 | 5/1987 | Denman et al. . | |
| 4,674,911 | 6/1987 | Gertz . | |
| 4,678,166 | 7/1987 | Bronstad et al. | 256/19 X |
| 4,688,766 | 8/1987 | Zucker . | |
| 4,711,481 | 12/1987 | Krage et al. . | |
| 4,815,565 | 3/1989 | Sicking et al. | 256/1 |

OTHER PUBLICATIONS

Michie et al., Guardrail Crash Test Evaluation, National Cooperative Highway Research Program Report No. 129;/1972.

Buth et al., Improved End Treatment for Metal Beam Guardrail, Texas Transportation Institute Research Report 189-1F, Study 2-10-76-189, May 1977.

Kimball et al., Evaluation of Guardrail Breakaway Cable Terminals, Federal Highway Administration Report No. 82-057, May 1982.

Energy Absorption Systems, Inc. Sentre (Safety Barrier End Treatment) NCHRP 230 Certification Report, May 1983.

Hinch et al., Safety Modifications of Turned-Down Guardrail Terminals, Federal Highway Administration Report No. 84-035, Jun. 1984.

Bronstad et al., Crash Test Evaluation of the Vehicle Attenuating Terminal, Presented at the 66th Annual Meeting of the Transportation Research Board, Nov. 1986.

*Primary Examiner*—Andrew V. Kundrat
*Assistant Examiner*—Peter M. Cuomo
*Attorney, Agent, or Firm*—Ronald B. Coolley

[57] ABSTRACT

A guardrail extruder terminal for flattening a W-beam guardrail and bending the guardrail to dissipate the energy of a vehicle impacting the end of the guardrail includes a feeder chute. The feeder chute is provided with an inlet in which the guardrail is positioned. The feeder chute extends into a terminal housing, and is in communication with a flattening throat. The fattening throat is of a smaller width than the feeder chute to flatten the W-beam. A bending member is also provided in the terminal to bend the guardrail in an curvilinear arc away from the impacting vehicle. Also included is a cable anchor releasably mounted on the guardrail. A cable extends from the cable anchor to a first post located at the end of the guardrail. The cable anchor includes lugs that release from the guardrail upon engagement of the extruder terminal with the cable anchor. To prevent turning or rotation of posts holding the guardrail as the extruder terminal and impacting vehicle move down the guardrail during a collision, a groundline cable extends through bores in each post.

8 Claims, 2 Drawing Sheets

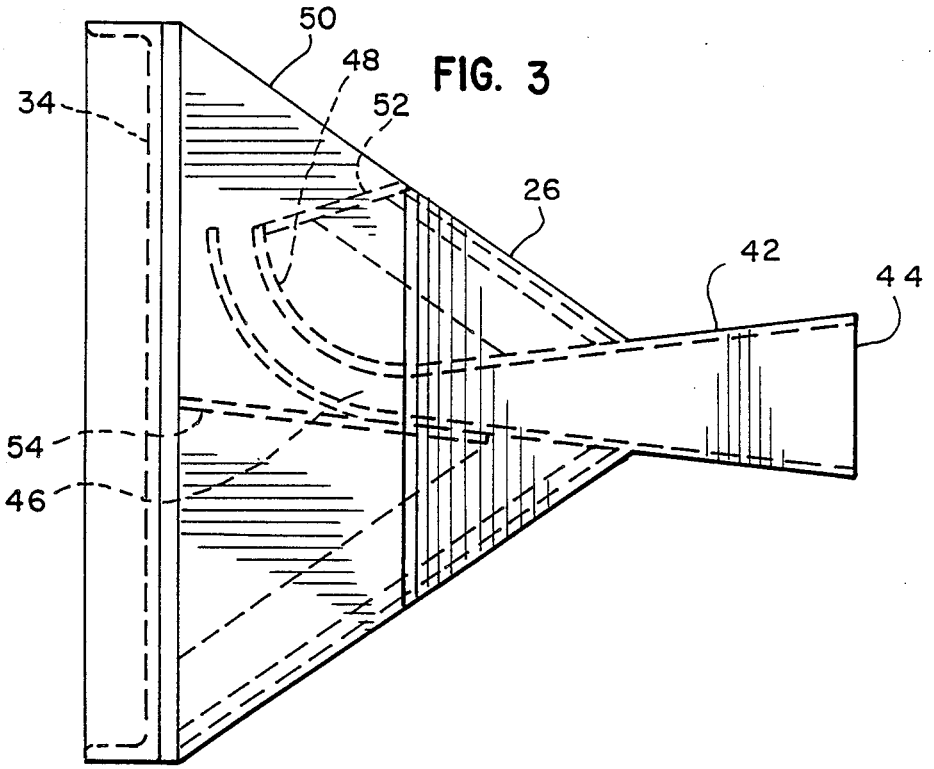
FIG. 3
FIG. 4
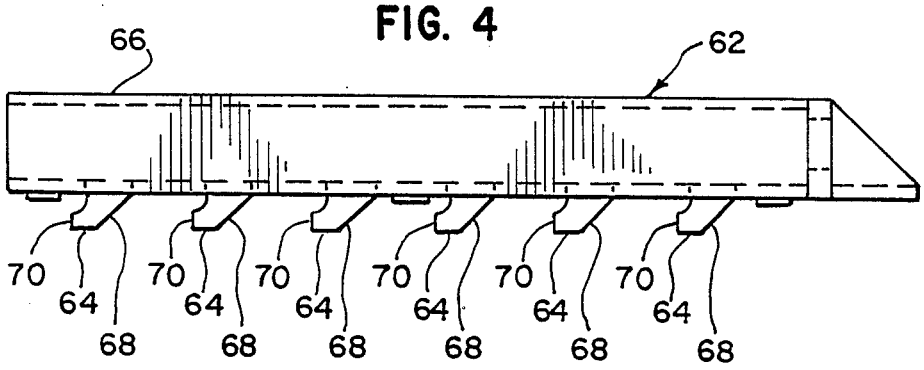

GUARDRAIL EXTRUDER TERMINAL

BACKGROUND OF THE INVENTION

A. Field of the Invention

The device of the present invention generally relates to a new and improved safety treatment for the ends of W-beam guardrails; and more particularly, to a new and improved guardrail extruder terminal that is mounted at the end of a W-beam guardrail for dissipating impact energy of a car colliding with the end of the W-beam guardrail in an accident.

B. Description of the Prior Art

Along most highways there are hazards that can be a substantial danger to drivers of automobiles if the automobiles were to leave the highway. To prevent accidents due to vehicles leaving a highway, guardrails are provided. Guardrails must be installed such that the terminal end of the guardrail facing the flow of traffic is not a hazard. Early guardrails had no proper termination at the ends, and it was not uncommon for impacting vehicles to become impaled on the guardrail causing intense deceleration of the vehicle and severe injury to the occupants. In some reported cases, the guardrail penetrated directly, into the occupant compartment of the vehicle fatally injuring the occupants.

Upon recognition of the problem of proper guardrail termination, guardrail designs were developed that used box beams and W-beams that allow tapering of the end of the guardrail into the ground providing a ramp and eliminating any spearing effect. While these end treatments successfully removed the danger of the vehicle being penetrated in a head-on collision, it was discovered that these end treatments could induce launching of the vehicle causing it to become airborne for a considerable distance with the possibility of roll over.

In search for better end treatments, improved end treatments such as break away cable terminals (BCT), vehicle attenuating terminals (VAT), and the Sentre end treatment were developed. These end treatments do not induce the dangerous vaulting and roll over of vehicles. The BCT end treatment is designed to cause a W-beam guardrail to buckle out of the way of an impacting vehicle. Since this design relies on dynamic buckling of the W-beam, it is sensitive to many installation details such as barrier flare rate and end off-set. Consequently, this design has not had a favorable service history.

The VAT safety treatment consists of overlapped guardrail sections that have a series of closely spaced slots. The guardrail segments are attached by bolts extending through the slots. When a vehicle impacts the end of this barrier, the bolts are forced to tear through the W-beam from one slot to the next. As a result, W-beam segments are cut into several long ribbons as an impacting vehicle is decelerated. The VAT safety treatment has no field service record, but it is believed that this system is too costly for wide spread implementation.

The Sentre end treatment is constructed from a series of break away steel guardrail posts and fragile plastic containers. Impacting vehicles are decelerated as the guardrail posts are broken and sand bags in the plastic containers are impacted. A cable is used to guide vehicles away from the guardrail during impact. This system is very expensive, and due to this expense, has not gained wide acceptance.

It would be desirable to develop an end treatment that can be used at virtually any end of a guardrail as a means of attenuating head on impacts as well as for providing anchorage for impacts to the sides of the barrier. It is also desirable that such an end treatment be easily installed and serviced and inexpensive to manufacture.

SUMMARY OF THE INVENTION

An object of the present invention is to provide a new and improved end treatment for highway guardrails.

Another object of the present invention is to provide a new and improved terminal for highway guardrails that is inexpensive and easy to install.

A further object of the present invention is to provide a new and improved guardrail extruder terminal that dissipates impact energy through the straining of W-beam guardrails.

A still further object of the present invention is to provide a new and improved W-beam guardrail end treatment that forces the guardrail through a bending structure which squeezes the guardrail into a relatively flat plate and bends it about a circular arc directed away from the impacting vehicle.

Another object of the present invention is to provide a new and improved end treatment for W-beam guardrail that dissipates impact energy and develops W-beam tensile capacity with a cable anchoring system that breaks off of the guardrail upon impact with the end treatment.

A still further object of the present invention is to provide a new and improved method for dissipating the impact energy of a vehicle colliding with an end of a guardrail by flattening and bending the guardrail.

Briefly, the present invention is directed to a new and improved device commonly referred to as an end treatment for a W-beam guardrail. The end treatment of the present invention is an extruder terminal that dissipates impact energy through straining of the guardrail. Specifically, the end treatment squeezes a W-beam guardrail into a relatively flat plate and bends the guardrail around an arc directed away from the impacting vehicle.

The extruder terminal includes a feeder chute into which the upstream end of a guardrail is positioned. The feeder chute gradually narrows to a narrow extruder throat. The extruder throat is narrower in width than the feeder chute. This reduction in width flattens a W-beam guardrail as it is forced through the chute and into the throat by impact of the terminal by a vehicle. The extruder terminal also includes a bending section downstream of the throat that bends the flattened guardrail in a curvilinear arc in a direction away from the impacting vehicle.

The extruder of the present invention further includes a cable anchor for providing tensile strength in the guardrail necessary for downstream collisions. The cable anchor includes a plurality of lugs each with an inclined surface. Each lug is mounted in an aperture in the guardrail at a location downstream of a first post on which the guardrail is mounted. A cable extends from the cable anchor and is anchored to the first post. The lugs are of a configuration such that upon engagement of the cable anchor by the feeder chute during a collision with a vehicle, the cable anchor releases from the apertures in the guardrail. By releasing from the guardrail, the cable anchor moves out of position with the feeder chute thus avoiding jamming of the extruder terminal.

A problem often encountered in guardrail systems during collision is that the posts mounting the guardrail tend to bend and rotate prior to breaking off. To overcome this bending or rotating problem, a groundline cable is provided. The groundline cable includes a cable extending through bores of a plurality of posts on which the guardrail is mounted. The groundline cable is anchored to one of these posts at first end of the cable, and extends upstream through the remaining posts and is anchored to the post upon which the extruder terminal is mounted. During a collision with the extruder terminal, the groundline cable prevents rotation of the posts while the bore in each post sufficiently weakens the posts allowing them to break off upon engagement with the extruder terminal and impacting vehicle.

BRIEF DESCRIPTION OF THE DRAWINGS

The above and other objects and advantages and novel features of the present invention will become apparent from the following detailed description of a preferred embodiment of the invention illustrated in the accompanying drawings wherein:

FIG. 3 is a detailed top plan view of the extruder terminal of the present invention; and FIG. 4 is an enlarged side elevation view of a cable anchor constructed in accordance with the principles of the present invention.

DESCRIPTION OF THE PREFERRED EMBODIMENT

Existing guardrail end treatments have proven to be unsafe, sensitive to installation details, or very costly. The present invention is a safety treatment for the ends of a W-beam guardrail which reduces end treatment costs and the number of injuries and deaths associated with guardrail terminal accidents.

Figure 2:
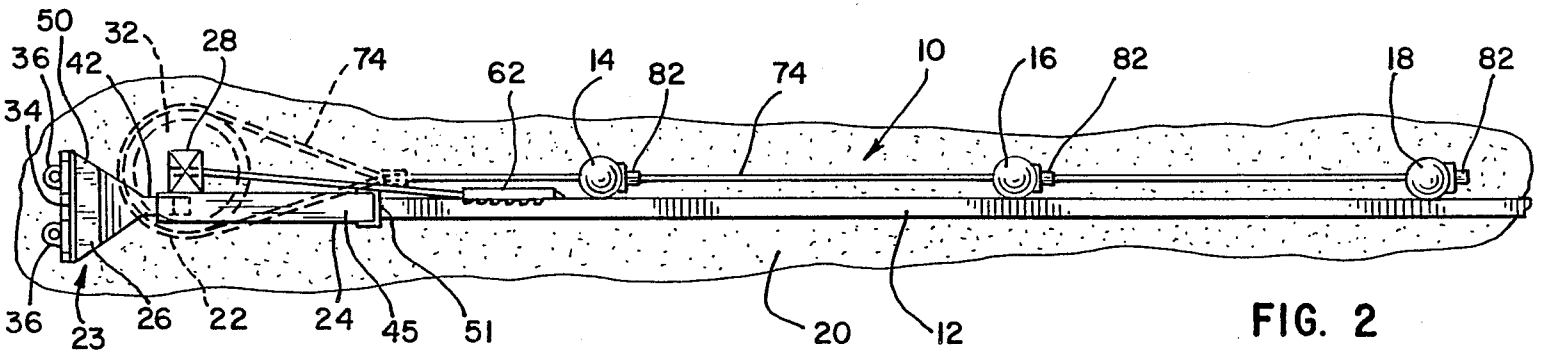
FIG. 2 is a top plan view of the guardrail system illustrated in FIG. 1.
Figure 1:
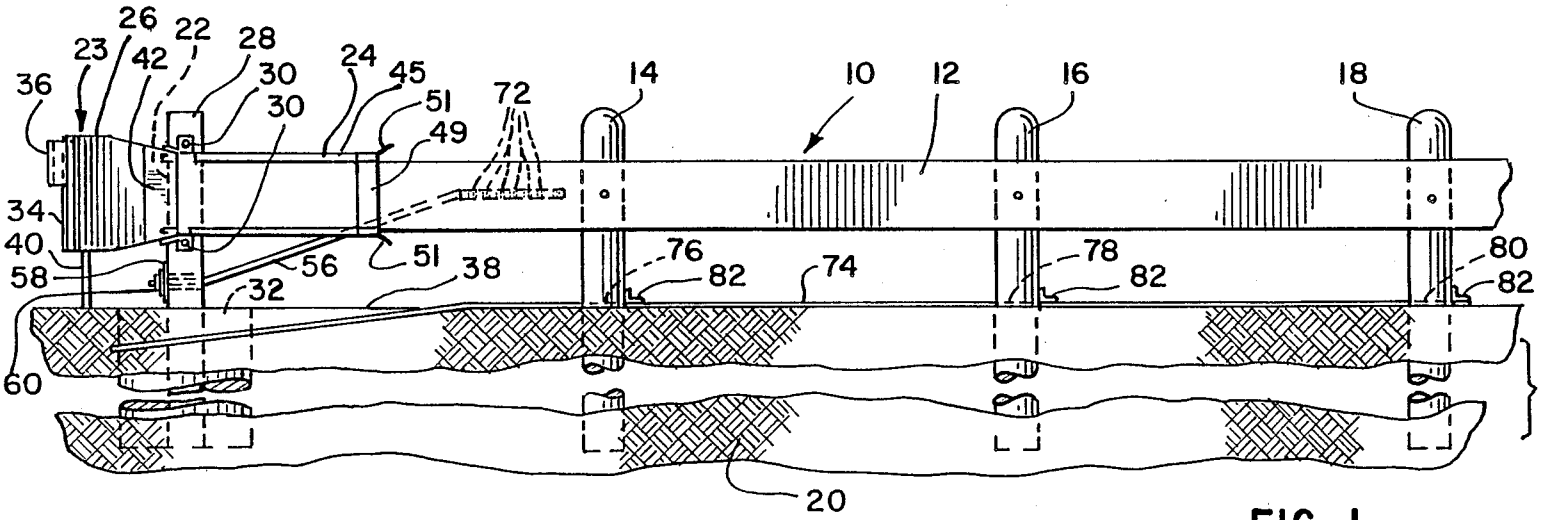
FIG. 1 is a side elevation view of a guardrail system including an extruder terminal constructed in accordance with the principles of the present invention.

A guardrail system including the present invention is generally designated by the reference numeral 10 and is illustrated in FIGS. 1 and 2. The guardrail system 10 includes a W-beam guardrail 12 mounted on a plurality of 7" round wooden posts 14, 16 and 18. The wooden posts 14, 16 and 18 are imbedded in soil 20. The guardrail 12 and the posts 14, 16 and 18 are typically mounted along a highway to prevent secondary collisions of vehicles leaving the highway. It is intended that a vehicle will impact the guardrail 12 downstream of its upstream end 22; however, a collision with the end 22 of the guardrail can occur with life threatening results. To minimize the potential for a life threatening accident with the end 22, an end treatment generally designated by the reference numeral 23 is provided. In a collision with the end 22, a vehicle will hit the end treatment 23. The purpose of the end treatment 23 is to dissipate impact energy of the vehicle without creating a dangerous condition such as causing the vehicle to roll-over or allow the guardrail 12 to spear the vehicle or the occupant compartment of the vehicle.

The end treatment 23 includes a feeder chute 24 and an extruder terminal 26. The extrusion terminal 26 is mounted onto a first post 28 by fasteners 30 such as bolts, and the upstream end 22 of the guardrail 12 extends into the feeder chute 24. The first post 28 is a rectangular 6"×8" wooden post embedded in concrete 32 in the soil or ground 20.

The extruder terminal 26 includes a front striking plate 34 and a pair of resilient bumpers 36 are secured to the front striking plate 34 to engage a vehicle upon collision. To ensure that the extruder terminal 26 is at the proper height relative to the groundline or level 38, one or more extruder legs 40 are secured to the bottom of the extruder terminal 26. The extruder legs 40 are intended to engage the groundline 38, and are primarily for support, but they also ensure that an installer accurately positions the extruder terminal 26 relative to the groundline 38.

During a collision, the feeder chute 24 functions as a guide to guide the guardrail 12 into an extruder chute 42 (FIG. 3). The feeder chute 24 is defined by an upper channel 45 and a lower channel 47. The upper channel 45 and lower channel 47 are joined by a pair of stabilizing plates 49. The stabilizing plates 49 provide stabilization necessary for guiding the W-beam guardrail 12 into the inlet 44 of the extruder chute 42 (FIG. 3). Bending of the feeder chute 24 will stop the movement of the extruder terminal 26, and the stabilization plates 49 provide sufficient bending strength to the feeder chute 24 to prevent or minimize bending during a collision.

The feeder chute 24 also keeps the extruder terminal 26 from rotating relative to the W-beam guardrail 12 during an impact or collision. If the extruder terminal 26 were to rotate during impact, the guardrail 12 would no longer feed into the extruder terminal 26 resulting in an immediate deceleration of the impacting vehicle and causing a dangerous condition.

The feeder chute 24 includes guides 51 that prevent shaving of the W-team guardrail 12 by the ends of the feeder chute 24 as the feeder chute 24 moves down the length of the W-beam guardrail during a collision. The guides 51 accommodate any irregularities or bumps in the W-beam guardrail 12 to ensure proper feeding of the guardrail 12 into the extruder terminal 26.

The extruder chute 42 includes an inlet 44 that, in a preferred embodiment, is 4" wide. This compares with the width of a typical W-beam guardrail which is 3" wide. The extruder chute 42 is funnel shaped and narrows down to an extruder throat 46 (FIG. 3). The extruder throat is 1" wide. As the w-beam guardrail 12 moves down the extruder chute 42 and into the extruder throat 46, it is flattened from 3" wide to 1" wide. As this flattening process occurs, substantial energy is dissipated slowing the impacting vehicle.

Once the W-beam guardrail 12 is flattened, the bending strength of the guardrail 12 is eliminated or substantially reduced. As the extruder terminal 26 moves further down the W-beam guardrail 12, the flattened W-beam guardrail 12 is forced through a curvilinear bending chute or member 48 (FIG. 3). The bending chute 48 must be relatively rigid to bend the flattened guardrail 12. To accomplish the desired rigidity, the bending chute 48 is secured to the housing of the extruder terminal 26 by a support 52. As the flattened W-beam guardrail 12 moves along the bending chute 48, it is bent in a curvilinear arc in a direction away from the impacting vehicle and exits the extruder terminal 26 through an outlet 50.

The radius of the bending chute 48 can be selected to bend the W-beam guardrail 12 in a circular path, an elliptical path, a spiral or any other configuration desired. It has been determined that different path result in different rates of dissipation of energy. As a result, the energy dissipation rate can be varied by the selection of the radius of the bending chute 48.

To maximize the impact force imparted to the extruder terminal 26 and thereby maximize the force used to flatten and bend the W-beam guardrail 12, a support plate 54 mechanically couples the front striking plate 34 and the extruder chute 42. The support 54 reduces the transmission of the impact force of the vehicle to the sides of the extruder terminal 26. Forces transmitted to the sides of the extruder terminal 26 could cause buckling of the housing of the extruder terminal 26.

Following the initial impact of a vehicle with the extruder terminal 26 and the initiation of the flattening and bending of the W-beam guardrail 12, the impacting vehicle and extruder terminal 26 engage the first post 28 breaking it at the groundline 38. As this occurs, a cable 56 anchored at a first end to the first post 28 by plates 58 and nut 60 is released. The cable 56 is a break away cable of the type used to provide tensile strength to the W-beam guardrail 12. The opposite or second end of the cable 56 is connected to a cable anchor 62. The cable anchor 62 includes a plurality of lugs 64 (FIG. 4) and a steel tube 66 on which the lugs 64 are welded. The lugs 64 are wedge shaped and include an inclined surface 68 and a lip 70. The lugs 64 protrude into apertures 72 formed in the W-beam guardrail 12 between the first post 28 and the second post 14.

Prior to impact with a vehicle, cable 56 is taunt and the lips 70 of the lugs 64 hook onto the sides of the apertures 72 securely holding the anchor 62 onto the W-beam guardrail 12. During a collision as the impacting vehicle breaks the first or lead post 28, the cable 56 is released at the first end. As the feeder chute 24 moves down the W-beam guardrail 12 during the collision, it engages the anchor 62. Since the tension has been released in cable 56, engagement of the feeder chute 24 with the anchor 62 causes the inclined surfaces 68 to engage the sides of the apertures 72. This engagement moves the lugs 64 out of the apertures 72 releasing the anchor 62 from the W-beam guardrail 12. The release of the anchor 62 moves it out of the way of the extruder terminal 26 thereby avoiding possible jamming of the movement of the terminal 26.

As the extruder terminal 26 continues moving down the W-beam guardrail 12 under the impacting force of the vehicle, the extruder terminal 26 and impacting vehicle engage the first wooden post 14. Upon impact, the first wooden post 14 is broken off at the groundline 38. Similarly, until the entire impact energy of the colliding vehicle is dissipated, the extruder terminal 26 moves downstream along the W-beam guardrail 12 breaking off the posts 16 and 18 at the groundline 38.

During the collision and movement of the extruder terminal 26 down the length of the W-beam guardrail 12, posts 14, 16 and 18 tend to bend. To prevent this bending and twisting of the posts 14, 16 and 18, past attempts have been to embed the posts 14, 16 and 18 in concrete. This procedure is extremely expensive. In accordance with the principles of the present invention, turning or twisting of the posts 14, 16 and 18 is eliminated using a groundline cable 74.

A first end of the groundline cable 74 is looped around and anchored to the concrete 32 in which the first or lead post 28 is embedded. The groundline cable 74 is anchored at a location below the groundline 38 to prevent release of the groundline cable 74 from its anchorage upon impact of the vehicle with the first post 28. The groundline cable 74 extends through a bore 76 in post 14, a bore 78 in post 16, and a bore 80 in post 18. The bores 76, 78 and 80 serve two functions. The first function is to allow a transverse mechanical connection between the groundline cable 74 and the posts 14, 16 and 18. Secondly, the bores 76, 78 and 80 weaken the posts 14, 16 and 18, respectively, at the groundline 38 ensuring that they will break off upon collision even when hit by a light weight vehicle.

Each post 14, 16 and 18 is secured to the groundline cable 74 by a backup plate and cable clamps 82. By being mechanically fixed to the groundline cable 74, the posts 14, 16 and 18 will not rotate or turn upon collision with a vehicle, but will break at the groundline 38 upon impact with the vehicle. This solution to the turning or twisting problem is inexpensive, and is easy to install.

Extruder terminal 26 has been described as first flattening the W-beam guardrail 12 and then bending it in a curvilinear arc away from the direction of travel of the impacting vehicle. It should be understood, however, that the extruder terminal 26 can be designed to bend the W-beam guardrail 12 without first flattening it. This can be accomplished by the elimination of the extruder throat 46, and designing the extruder chute 42 without a reduction in width so that flattening does not occur. With these changes, the unflattened W-beam guardrail 12 is fed directly into the bending chute 48.

Existing guardrail end treatments have proven to be unsafe, sensitive to installation details, and costly. The extruder terminal 26 of the present invention meets national safety requirements, and is inexpensive compared to other available end treatments since the extruder terminal 26 has fe; parts and is not sensitive to installation details. The extruder terminal 26 has the additional advantage that is does not require the end of the guardrail 12 to be flared away from the traveled way, and it can be used at virtually any roadside location.

What is claimed and sought to be secured by Letters Patent of the United States is:

1. A highway guardrail system comprising a horizontally extending W-beam type guardrail mounted on a plurality of posts, and an extruder terminal connected to an end of said guardrail for engaging an impacting vehicle at the end of said guardrail, said terminal including a housing having an inlet for receiving the end of said guardrail, a squeezing extruder throat within said housing for telescoping over said guard rail and flattening the guardrail as said terminal is advanced longitudinally along the guardrail by an impacting vehicle, thereby dissipating energy to decelerate the impacting vehicle, and bending means extending laterally from said squeezing extruder throat for bending the flattened guardrail laterally away from the longitudinal axis of said guardrail so as to remote the flattened guardrail from the path of an impacting vehicle advancing said terminal along the guardrail.

2. The guardrail system of claim 1 which includes a feeder chute between said housing inlet and the end of said guardrail for guiding said squeezing extruder throat over the end of said guardrail upon advancement of said terminal toward the end of said guardrail in response to the impact of a vehicle on said terminal.

3. The guardrail system of claim 2 further including guiding lips on said feeder chute.

4. The guardrail system of claim 1 which includes a cable anchor on said guardrail for receiving a tension cable, said cable anchor including means for releasing said cable anchor from said guardrail upon advancement of said extruder terminal toward said guardrail.

5. The guardrail system of claim 4 wherein said releasing means includes a plurality of apertures in said guardrail, said cable anchor including a plurality of lugs, said lugs extending into said apertures, each said lug including an inclined surface engaging a side of each aperture.

6. The guardrail system of claim 1 further comprising a front striking plate on said housing, and resilient pads on said striking plate.

7. The guardrail system of claim 1 wherein each said post includes a bore, a cable extending through each said bore, a first end of said cable secured to a first post, a second end of said cable secured to a second post, and means for fixing said cable relative to each post.

8. The guardrail system of claim 1 further comprising an outlet in said housing adjacent said bending means to allow exit of the flattened and bent guardrail from said housing.

* * * * *